US008141662B2

(12) United States Patent
Hall et al.

(10) Patent No.: US 8,141,662 B2
(45) **Date of Patent: *Mar. 27, 2012**

(54) DOWNHOLE LUBRICATION SYSTEM

(75) Inventors: David R. Hall, Provo, UT (US); Francis Leany, Salem, UT (US); Michael Beazer, Provo, UT (US); Casey Webb, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/494,802

(22) Filed: Jun. 30, 2009

(65) Prior Publication Data

US 2010/0326735 A1 Dec. 30, 2010

(51) Int. Cl.
*E21B 10/24* (2006.01)

(52) U.S. Cl. ..... 175/228; 175/229

(58) Field of Classification Search ..... 175/227, 175/228, 229

See application file for complete search history.

(56) References Cited

U.S. PATENT DOCUMENTS

| | | | | | |
|---|---|---|---|---|---|
| 2,751,196 | A | | 6/1956 | Smith | |
| 2,831,660 | A | | 4/1958 | Srniecinski | |
| 2,880,970 | A | | 4/1959 | Swart | |
| 3,007,750 | A | * | 11/1961 | Cunningham | 384/466 |
| 3,007,751 | A | | 11/1961 | Eenink | |
| 3,017,937 | A | | 1/1962 | Bobo | |
| 3,048,230 | A | * | 8/1962 | Angel | 175/228 |
| 3,529,688 | A | * | 9/1970 | Bruce | 180/9.23 |
| 3,917,028 | A | | 11/1975 | Garner | |
| 4,055,225 | A | | 10/1977 | Millsapps | |
| 4,158,394 | A | | 6/1979 | Ernst et al. | |
| 4,183,416 | A | | 1/1980 | Walters | |
| 4,183,417 | A | | 1/1980 | Levefelt | |
| RE30,257 | E | * | 4/1980 | Fox | 175/107 |
| 4,199,856 | A | | 4/1980 | Farrow et al. | |
| 4,335,791 | A | * | 6/1982 | Evans | 175/228 |
| 4,388,973 | A | * | 6/1983 | Winkelmann et al. | 175/321 |
| 4,428,442 | A | | 1/1984 | Steinke | |
| 4,436,164 | A | * | 3/1984 | Garner | 175/39 |
| 5,377,771 | A | * | 1/1995 | Wenzel | 175/107 |
| 5,513,711 | A | | 5/1996 | Williams | |
| 6,206,110 | B1 | | 3/2001 | Slaughter, Jr. et al. | |
| 6,631,772 | B2 | | 10/2003 | Palaschenko | |
| 7,195,086 | B2 | | 3/2007 | Aaron et al. | |
| 7,237,627 | B2 | | 7/2007 | Richman et al. | |
| 7,360,612 | B2 | | 4/2008 | Chen et al. | |
| 7,434,632 | B2 | | 10/2008 | Chen et al. | |
| 7,624,823 | B2 | | 12/2009 | Chen | |

OTHER PUBLICATIONS

Bourgoyne, Chenevert, Millheim, and Young, Applied Drilling Engineering, 1991, 193-198, Society of Petroleum Engineers, Richardson, TX.

* cited by examiner

*Primary Examiner* — William P Neuder
(74) *Attorney, Agent, or Firm* — Brinks Hofer Gilson & Lione

(57) ABSTRACT

What is claimed is a downhole lubrication system comprising a drill string component comprising an outer diameter and an inner bore. A reservoir may be disposed intermediate the outer diameter and inner bore. A piston may be disposed at least partially within the reservoir. At least one channel may extend from the reservoir to a bearing surface. As drilling fluid is passed through the inner bore, the piston may be pressurized, urging lubricant toward the bearing surface via the at least one channel.

21 Claims, 12 Drawing Sheets

DOWNHOLE LUBRICATION SYSTEM

BACKGROUND OF THE INVENTION

The present invention relates to the field of borehole drilling, and especially to the field of geothermal borehole drilling. Boreholes may be drilled into the earth for various reasons including the extraction of water, minerals, other liquids (such as petroleum), or gases (such as natural gas). Geothermal drilling generally involves drilling a borehole into the earth in order to access the internal heat of the earth. In various applications, heat may be extracted from the earth and removed to the surface or the earth may be used as a heat sink and heat from the surface may be deposited in the earth.

Geothermal drilling often requires boreholes of greater depth than those required for extraction of desirable materials. Efforts have been made in the field of geothermal drilling to reach borehole depths greater than previously possible. With increased depth, an increase in heat and pressure may be experienced. Seals and bearing surfaces within a drill bit may deteriorate faster by an increased amount of heat and pressure. In addition, as a borehole increases in depth, there is a greater chance for debris to infiltrate bearing cavities and surfaces causing the bearings to wear faster.

U.S. Pat. No. 4,158,394 to Ernst et al., which is herein incorporated by reference for all it contains, discloses a system for lubricating bearings in a drilling apparatus including a roller bit with at least one pivot and a cutting roller rotatably supported on the pivot by bearings. A cavity or chamber is formed in the roller bit for a non-compressible flushing liquid. The flow channel which communicates with the chamber at one end and the bearing cavity at the other end, provides a flow path for the flushing liquid to the bearing cavity. In one form the flushing liquid discharges to the bearing cavity at a point remote from an annular gap between the outer axial end face of the cutting roller and the roller bit. In another embodiment circumferentially spaced discharge ports are located between the bearings so that a portion of the flushing liquid is discharged to the environment and the remainder flows through the bearings and out the annular gap.

U.S. Pat. No. 5,513,711 to Williams, which is herein incorporated by reference for all it contains, discloses a rotary cone drill bit for forming a borehole including a support arm-cutter assembly. A support arm is integrally formed with the drill bit's body with a spindle machined integral thereto. The assembly includes a cutter with a cavity for receiving the spindle. An inner seal gland is formed between the spindle and a wall of the cavity. An elastomeric seal is disposed in the inner seal gland to form a first fluid barrier between. An outer seal gland is formed between the spindle and the cavity wall and between the inner seal gland and the borehole. A ring is disposed in the outer seal gland to rotate with the cutter. The ring has a peripheral hole therethrough. A gas conduit is disposed within the support arm for directing a flow of a gas, such as air, into the outer seal gland. From the outer seal gland, the gas is directed through the hole in the ring and exits into the borehole to form high velocity jets of air to clean a mating surface between the arm and the cutter preventing borehole debris from entering the inner seal gland.

BRIEF SUMMARY OF THE INVENTION

In various embodiments of the invention, a downhole lubrication system comprises a drill string component comprising an outer diameter and an inner bore, a reservoir disposed intermediate the outer diameter and inner bore, at least one channel extending from the reservoir to a bearing surface and wherein lubricant is urged from the reservoir toward the bearing surface via the at least one channel.

The length of the drill string component may define the volume of the reservoir. The length of the drill string component may be determined by a downhole parameter. The downhole parameter may comprise weight on bit, depth of penetration, rate of penetration, rock porosity, rock density, or durability of bit. The inner bore may be formed by a removable insert. The removable insert may comprise a connection to a bit. The connection to the bit may comprise a threadform. The at least one channel may comprise a plug such that the channel is accessible from the outer diameter by removing the plug. The plug may comprise a Zerk fitting. The plug may comprise a check valve. The plug may comprise an external covering. The external covering may comprise a threaded securement. The at least one channel may comprise an annular gap disposed within a joint of the drill string. The annular gap may be segmented. The joint may comprise first and second mating surfaces and the annular gap may be disposed on the first mating surface or both the first and second mating surfaces. The downhole lubrication system may also comprise a plurality of channels extending from the reservoir to the bearing surface. The lubricant may comprise an operating range of 25 degrees C. to 350 degrees C. The reservoir may comprise an axial length from 4 inches to 30 feet. The reservoir may comprise a capacity from 0.4 gallons to 45 gallons.

In other embodiments of the invention, a downhole lubrication system comprises a drill string component comprising a reservoir, a piston disposed at least partially within the reservoir, at least one channel extending from the reservoir to a bearing surface and wherein lubricant is urged from the reservoir toward the bearing surface via the at least one channel by the piston.

As drilling fluid is passed through the inner bore, the piston may be biased by the drilling fluid to urge lubricant from the reservoir toward the bearing surface via the at least one channel. The downhole lubrication system may also comprise a diverter disposed within the drill string component, wherein the diverter directs drilling fluid to bias the piston. The piston may comprise a removable plug such that the reservoir is fluidly connected to the bore when removed. The lubrication system may also comprise a spring in mechanical communication with the piston, wherein the piston is biased by the spring to urge lubricant toward the bearing surface via the at least one channel. The bearing surface may comprise a first metal surface and a seal element may comprise a second metal surface, wherein the first metal surface contacts the second metal surface. The second metal surface may be biased toward the first metal surface by an E-clip, wave spring, elastic washer or other elastic material known in the art. The seal element may comprise a C-clip or other metallic seal known in the art. As lubricant is urged from the reservoir toward the bearing surface via the at least one channel it may seep between the first metal surface and the second metal surface. The lubrication system may further comprise at least one thrust bearing and wherein as lubricant is urged from the reservoir toward the bearing surface via the at least one channel it lubricates the thrust bearing. The at least one thrust bearing may comprise a hydrodynamic thrust bearing and/or diamond thrust bearing. The lubrication system may further comprise at least one ball retainer and wherein as lubricant is urged from the reservoir toward the bearing surface via the at least one channel it lubricates the ball retainer. The bearing surface may be disposed intermediate a roller cone and a journal, and create a slidable connection allowing the roller cone to rotate with respect to the journal.

The roller cone may comprise at least one cutter comprising a superhard material selected from the group consisting of diamond, polycrystalline diamond, and cubic boron nitride. The at least one cutter may comprise a superhard material bonded to a cemented metal carbide substrate at an interface, wherein the superhard material comprises a substantially pointed geometry with an apex comprising 0.050 to 0.160 inch radius; and the superhard material comprises a 0.100 to 0.500 inch thickness from the apex to the interface; and wherein the substantially conical surface comprises a side which forms a 35 to 55 degree angle with a central axis of the cutter. The lubrication system may comprise a tortuous path disposed intermittent the roller cone and the journal. The bearing surface may be disposed intermediate a hammer and a bit body, and creates a slidable connection allowing the hammer to oscillate with respect to the bit body.

DETAILED DESCRIPTION OF THE INVENTION AND THE PREFERRED EMBODIMENT

Figure 1:
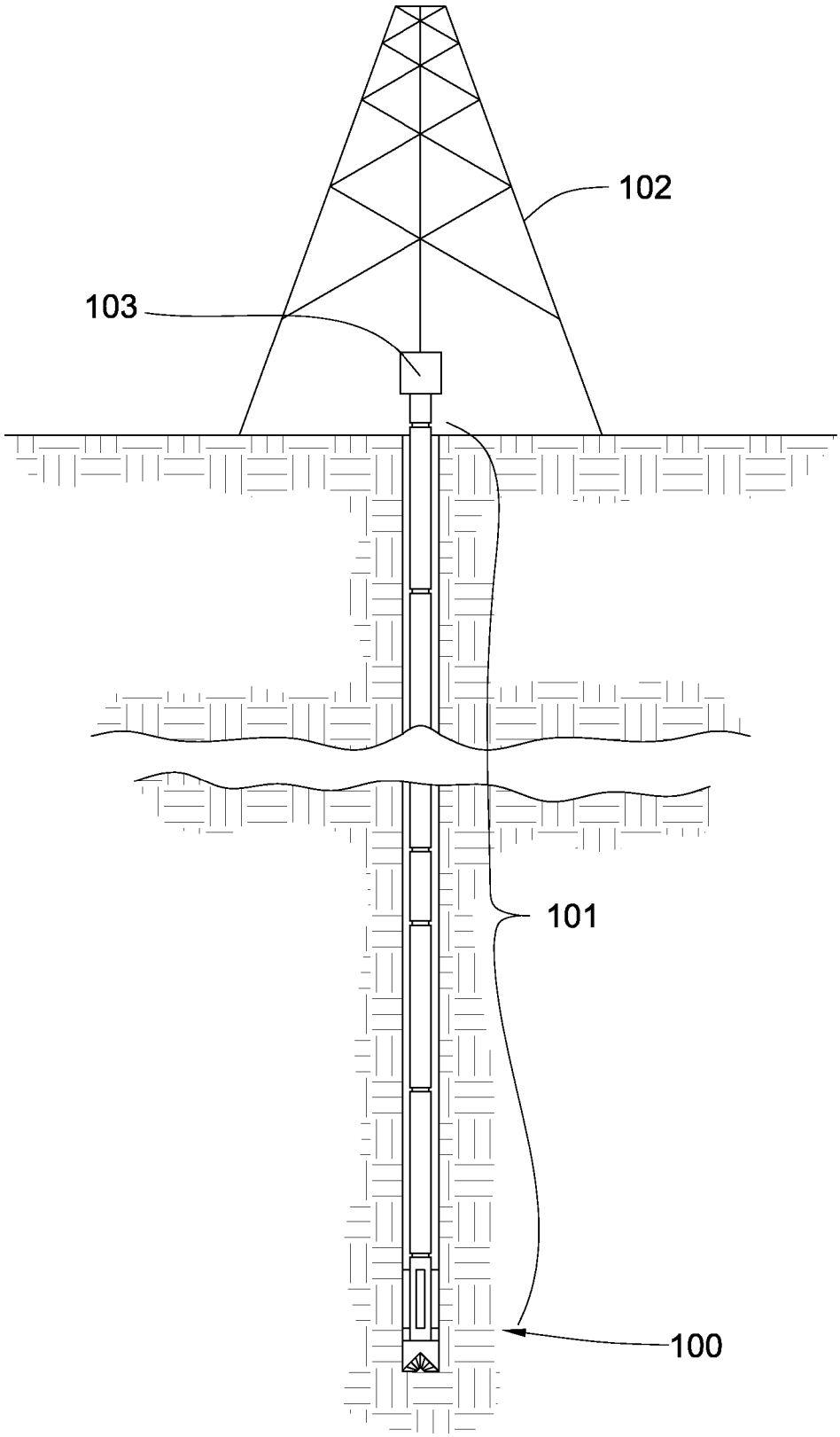
FIG. 1 is a cross-sectional view of an embodiment of a downhole drill string.

Moving now to the figures, FIG. 1 displays a cross-sectional diagram of an embodiment of a downhole drill string 101. The downhole drill string 101 may be suspended by a derrick 102. The drill string 101 may comprise one or more downhole components 100 linked together and in communication with an uphole assembly 103.

Figure 2:
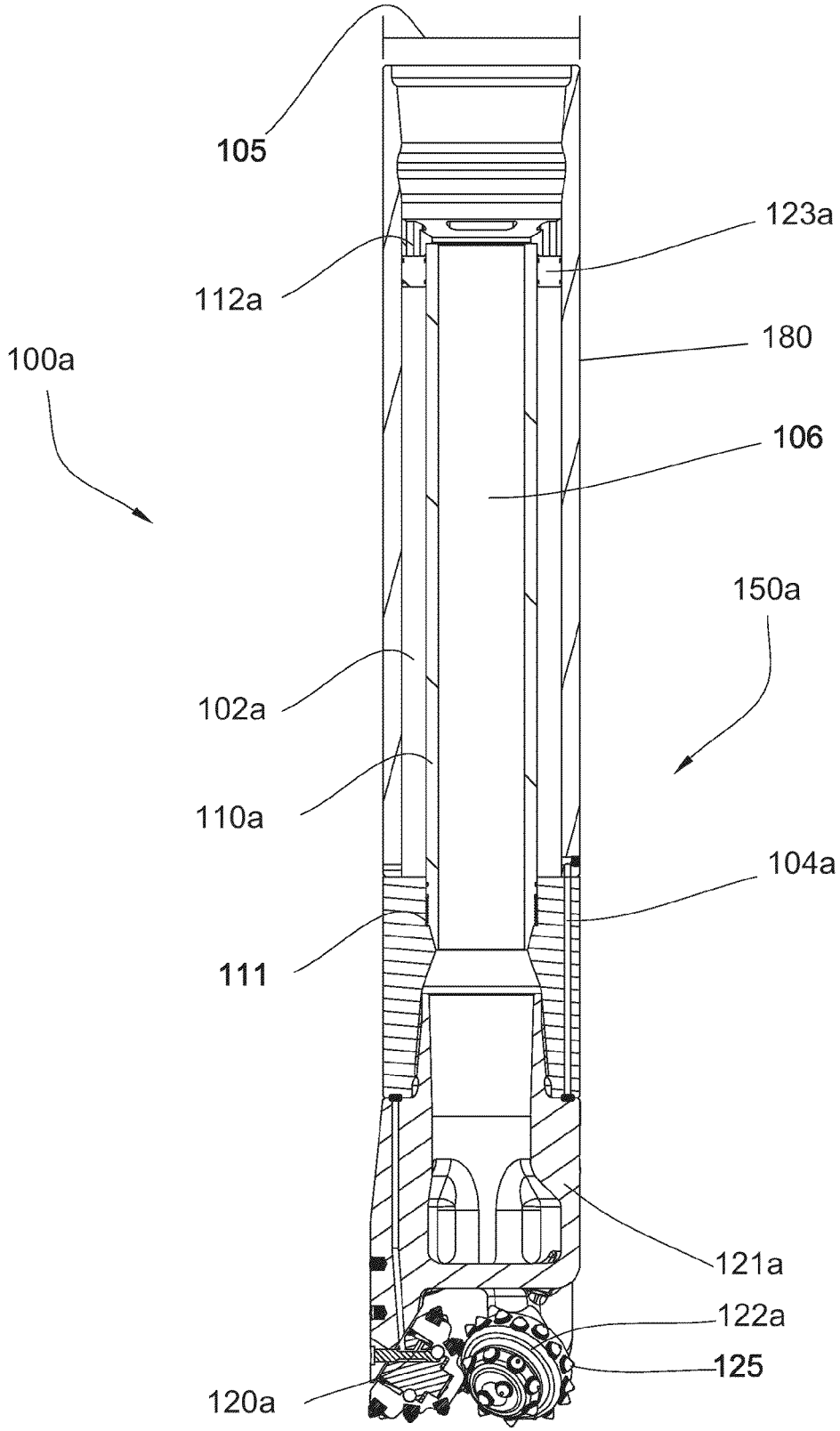
FIG. 2 is a cross-sectional view of an embodiment of a drill string component comprising a lubrication system.

FIG. 2 shows a cross-sectional view of an embodiment of a drill string component 100*a* comprising a lubrication assembly 150*a*. The lubrication assembly 150*a* may comprise a reservoir 102*a*. The reservoir 102*a* in the embodiment shown is disposed between an outer surface 180 having a diameter 105 and an inner bore 106. The inner bore 106 may be formed by placing an insert 110*a* within the drill string component 100*a*. The insert 110*a* may be secured within the drill string component 100*a* through a threadform 111. A piston 123*a* may be disposed within the reservoir 102*a* and around the insert 110. A diverter 112*a* may then be disposed over the piston 123*a*.

As drilling fluid is introduced into the drill string component 101*a*, the drilling fluid may be diverted through the diverter 112*a* to impinge on the piston 123*a*. With a fluid pressure urging the piston 123*a* through the reservoir 102*a*, lubricant found within the reservoir 102*a* may be pressurized causing it to be forced into a channel 104*a* leading to a bearing surface 120*a*. In the embodiment shown, the bearing surface 120*a* is part of a roller cone bit 121*a* comprising at least one roller cone 122*a*. The roller cone 122*a* may comprise a plurality of cutters 125. Each of the plurality of cutters 125 may comprise a thick pointed superhard material such as diamond, polycrystalline diamond, or cubic boron nitride. Thick pointed superhard materials suitable for use in the embodiment shown are disclosed in U.S. Pat. Pub. No. US 2009/0051211 to Hall, which is herein incorporated by reference for all that it discloses.

The volume of the reservoir 102*a* may be determined by increasing or decreasing the length of the insert 110*a*. The length of the insert 110*a* may be 4 inches to 30 feet and the volume of the reservoir may be 0.4 gallons to 45 gallons. An increase in the volume of the reservoir 102*a* may allow for an increase in the amount of lubricant which in turn may allow the drill string component 100*a* to operate for a longer period of time. The lubricant may be suitable at a temperature range of 25 degrees Celsius to 350 degrees Celsius.

Figure 3:
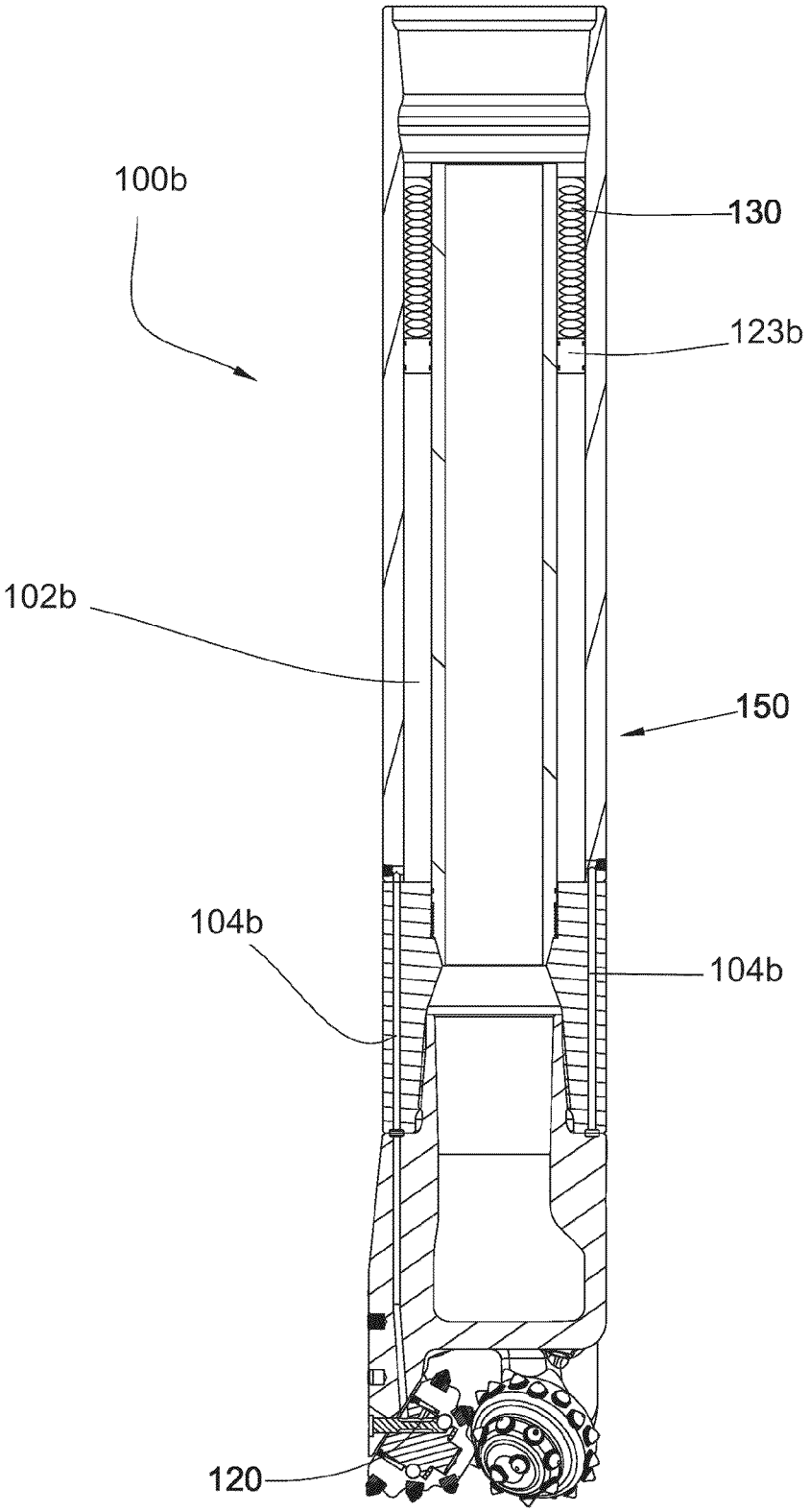
FIG. 3 is a cross-sectional view of another embodiment of a drill string component comprising a lubrication system.

FIG. 3 shows a cross-sectional view of another embodiment of a drill string component 100*b* comprising a lubrication assembly 150*b*. In this embodiment, a piston 123*b* is urged through a reservoir 102*b* by a spring mechanism 130. This urging of the piston 123*b* may cause lubricant found within the reservoir 102*b* to be pressurized causing it to be forced into a channel 104*b* leading to a bearing surface 120*b*. In the embodiment of FIG. 2, the single channel 104*a* was fluidly connected to the reservoir 102*a*. However, as shown in the embodiment of FIG. 3, multiple channels 104*b* may be fluidly connected to the reservoir 102*b*.

Figure 4A:
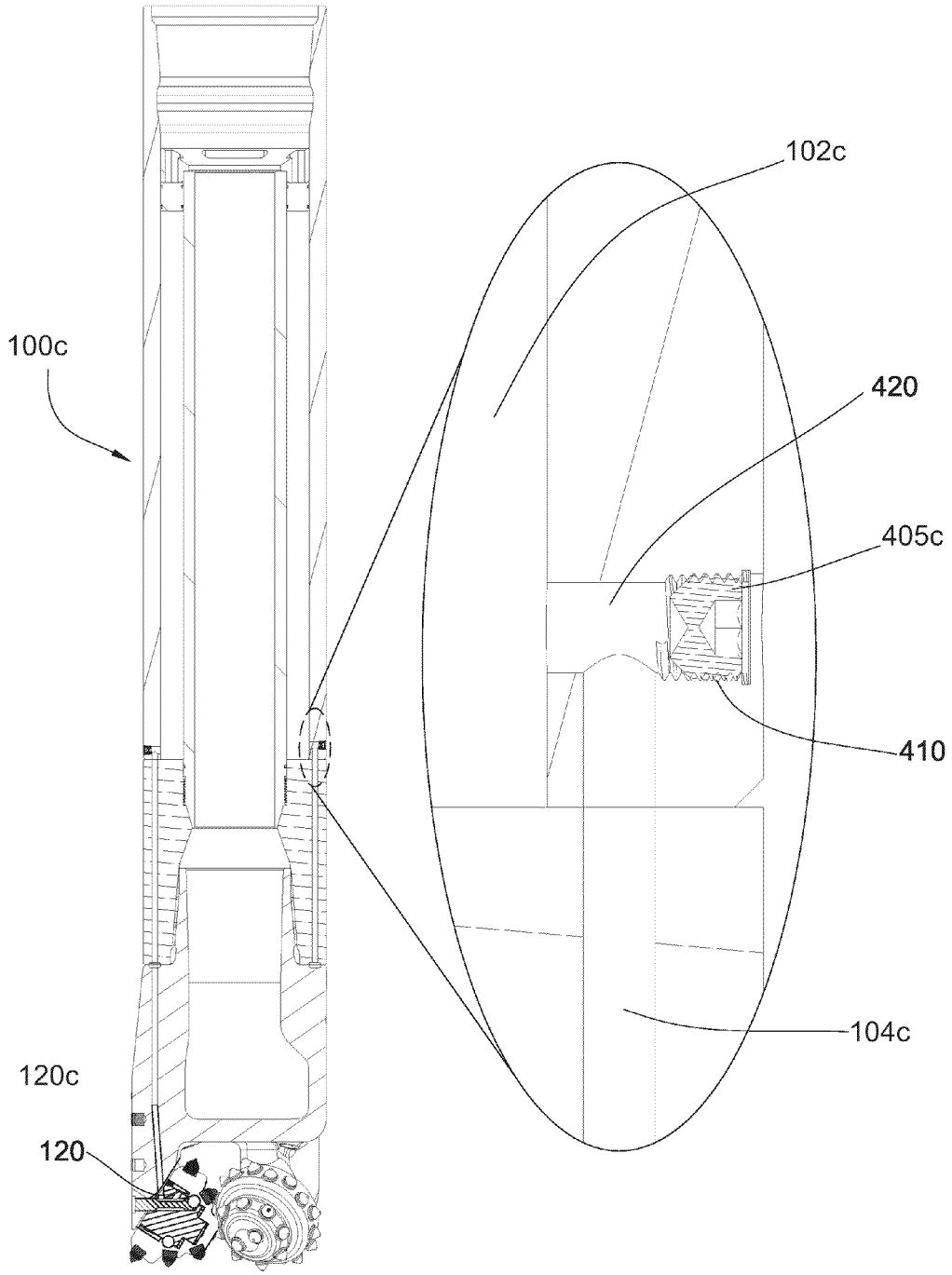
FIG. 4*a* is a cross-sectional view of an embodiment of a drill string component comprising a lubrication system comprising a close-up view of a plug.

FIG. 4*a* shows a cross-sectional view of an embodiment of a drill string component 100*c* with a close-up view of a plug 405*c*. In this embodiment, the plug 405*c* includes a threadform 410 that may thread into a port 420. The port 420 opens into a channel 104*c* that may connect the reservoir 102*c* to a bearing surface 120*c*. Lubricant may be added to the reservoir 102*c* from outside of the drill string component 100*c* by removing the plug 405*c* from the port 420.

Figure 4B:
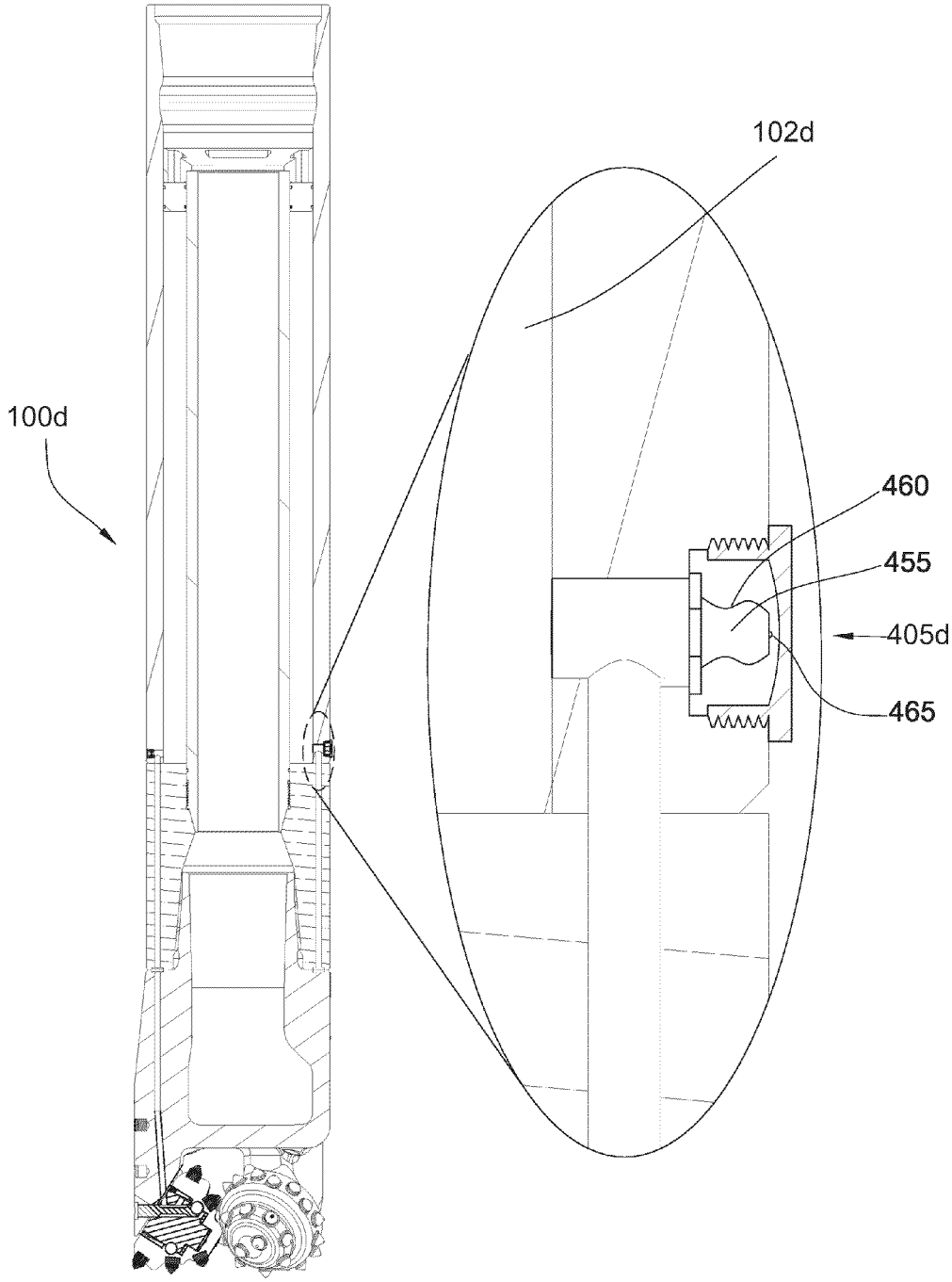
FIG. 4*b* is a cross-sectional view of another embodiment of a drill string component comprising a lubrication system comprising a close-up view of a plug.

FIG. 4*b* shows a cross-sectional view of another embodiment of a drill string component 100*d* with a close-up view of a plug 405*d*. In this embodiment, the plug 405*d* comprises a Zerk fitting 455. The Zerk fitting 455 comprises a nipple 460 and a check valve 465. The check valve 465 may allow lubricant to flow one direction through the check valve 465 but hinder such movement in the reverse direction. A grease gun (not shown) may be placed over the nipple 460 and force lubricant through the check valve 465 and into the reservoir 102*d*.

Figure 5:
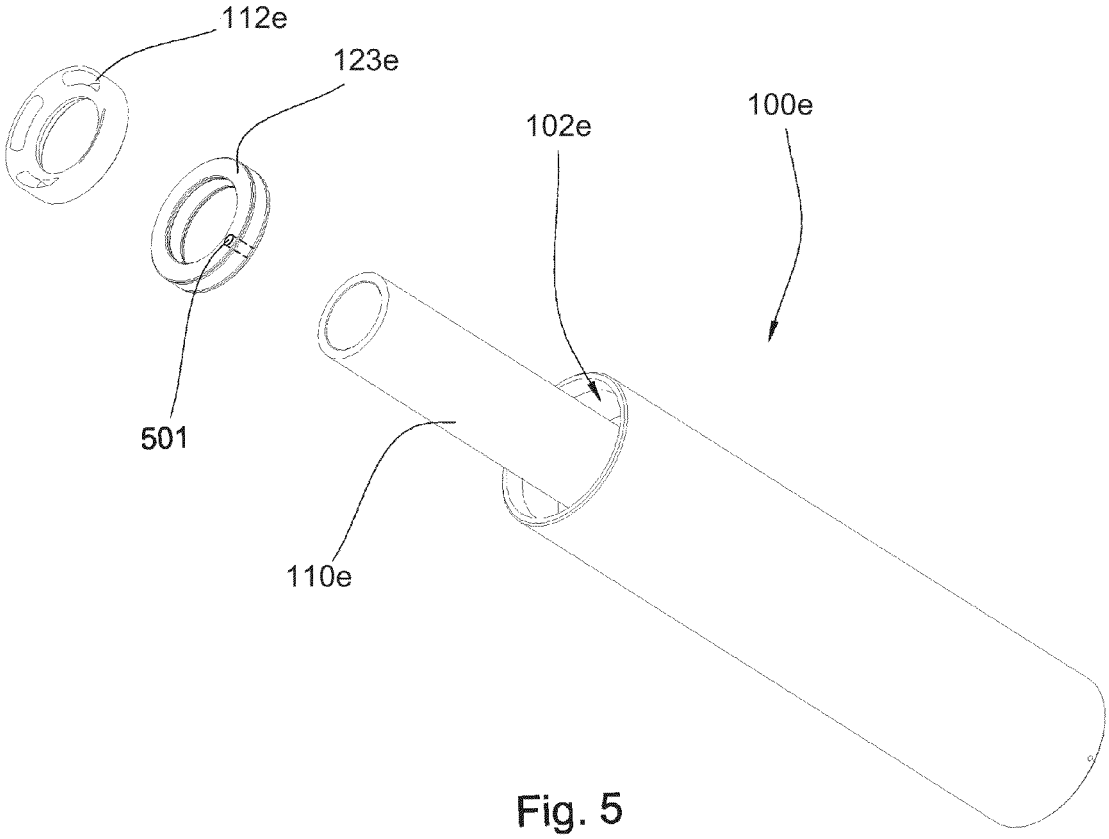
FIG. 5 is an exploded view of an embodiment of a drill string component comprising a lubrication system.

FIG. 5 shows a perspective exploded diagram of an embodiment of a downhole drill string component 100*e*. The drill string component 100*e* may comprise a diverter 112*e*, a piston 123*e* and an insert 110*e*. When inserted into the drill string component 100*e*, the insert 110*e* may form part of a reservoir 102*e*. The piston 123*e* may seal the reservoir 102*e*. The diverter 112*e* may direct drilling fluid flowing through the drill string component 100*e* against the piston 123*e*. In this embodiment, the piston 123*e* comprises a plug 501 such that as the piston 123*e* is placed over the insert 110*e*, the plug 501 may be removed and lubrication may be added to the reservoir 102*e* through the piston 123*e*.

Figure 6A:
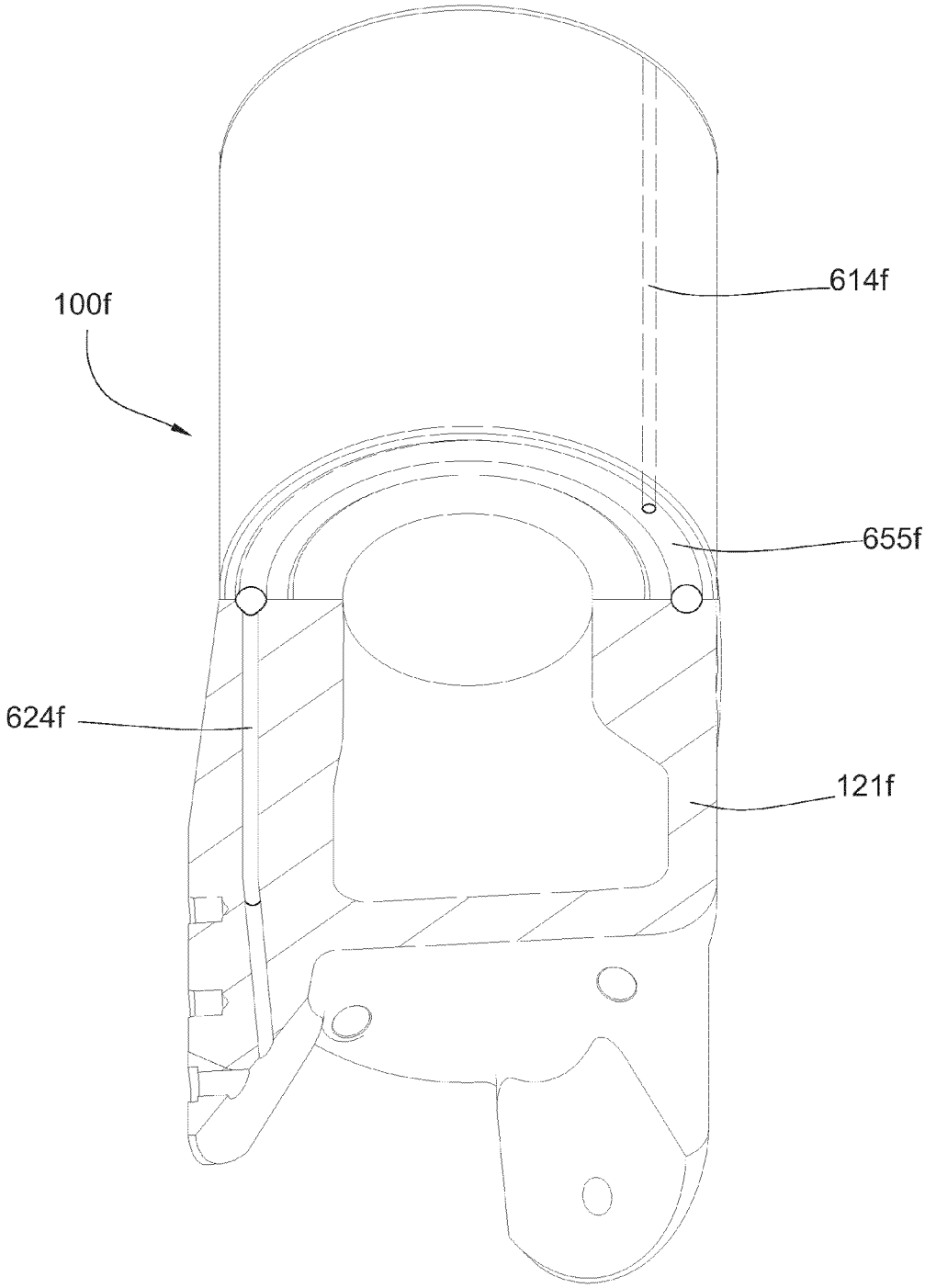
FIG. 6*a* is a partial cross-sectional view of an embodiment of a drill string component comprising a joint of the drill string.

FIG. 6*a* shows a partial cross-sectional view of an embodiment of a drill string component 100*f* comprising a roller cone bit 121*f*. In this depiction, the roller cones and journals have been removed to emphasize some unique features. An annular gap 655*f* may be disposed between the roller cone bit 121*f* and the remainder of the drill string component 100*f*. The annular gap 655*f* may allow lubricant in an upper channel 614*f* to flow into a lower channel 624*f* regardless of the roller cone bit's 121*f* axial orientation. In this embodiment, the annular gap 655*f* is formed in both surfaces that form the connection between the roller cone bit 121*f* and the remainder of the drill string component 100*f*.

Figure 6B:
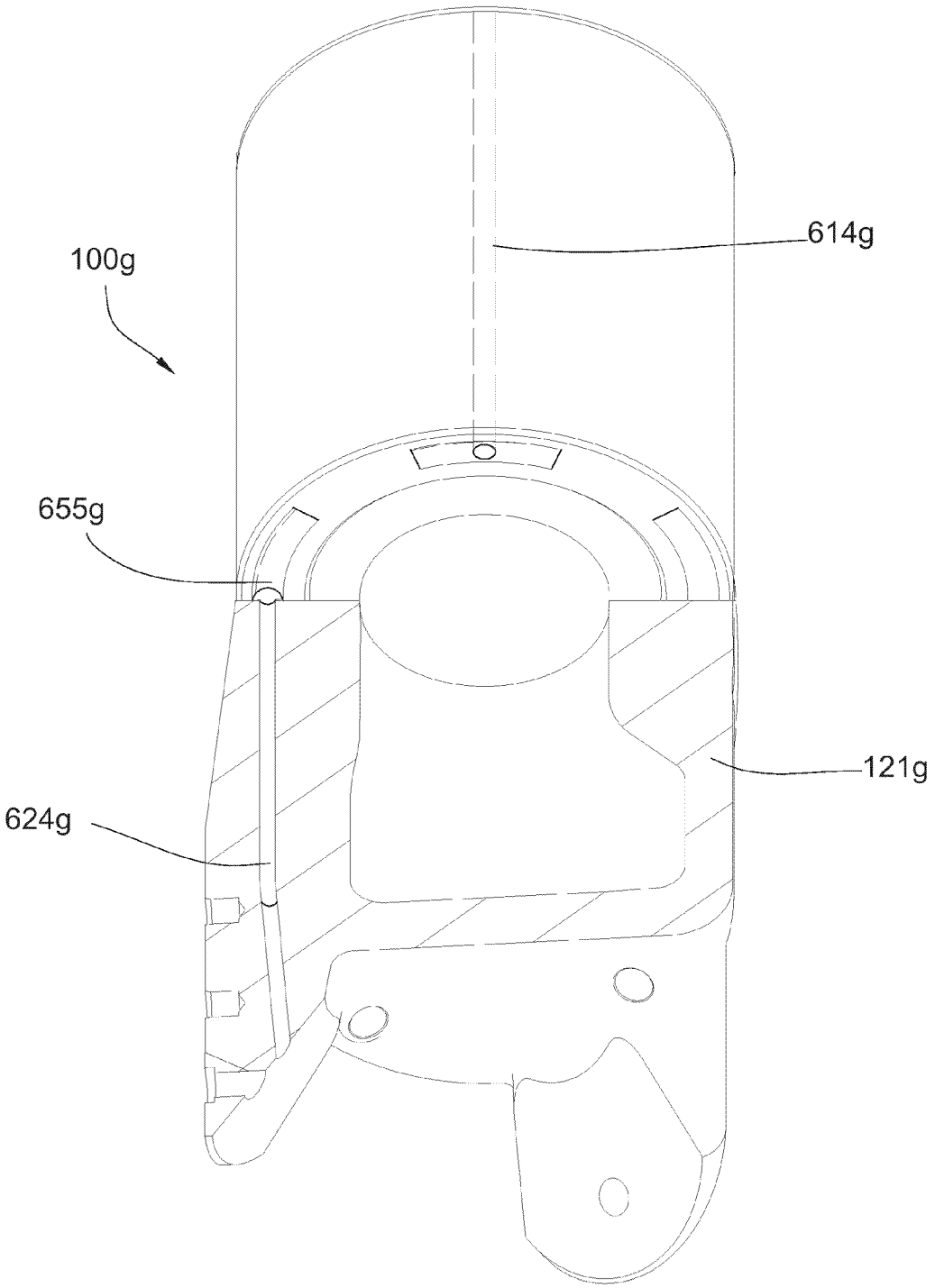
FIG. 6*b* is a partial cross-sectional view of another embodiment of a drill string component comprising a joint of the drill string.

FIG. 6*b* shows a partial cross-sectional view of another embodiment of a drill string component 100*g* comprising a roller cone bit 121*g* with the roller cones and journals removed. In this embodiment, the annular gap 655*g* is segmented such that only certain upper channels 614*g* flow into certain lower channels 624*g*. Additionally, in this embodiment, the annular gap 655*g* is formed in only one of the surfaces that form the connection between the roller cone bit 121*g* and the remainder of the drill string component 100*g*.

Figure 7:
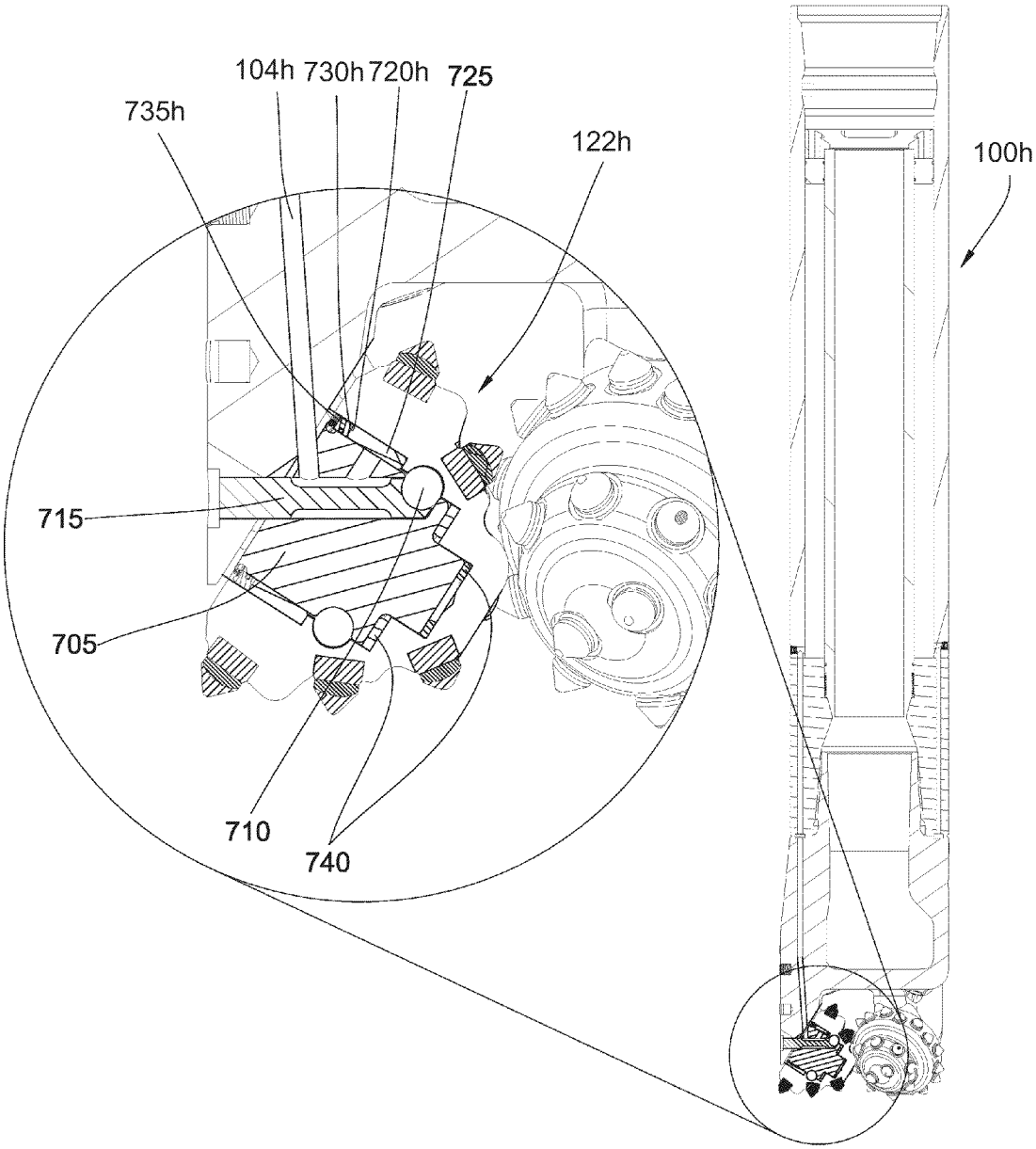
FIG. 7 is a cross-sectional view of an embodiment of a drill string component comprising a close-up view of a roller cone.

FIG. 7 shows a cross-sectional view of an embodiment of a drill string component 100*h* comprising a close-up view of a roller cone 122*h*. The roller cone 122*h* may rotate around a journal 705. A plurality of ball retainers 710 may be inserted into the journal 705 to secure the roller cone 122*h* onto the journal 705. The ball retainers 710 may then be held in place by a ball retention rod 715.

The roller cone 122*h* may comprise a bearing surface. In the embodiment depicted in FIG. 7 the bearing surface is composed of a first metal surface 720*h* disposed on a journal bearing 725. A second metal surface 730*h* may be disposed on a seal element 735*h* that is biased to urge the second metal surface 730*h* toward the first metal surface 720*h* as the first metal surface 720*h* rotates with respect to the second metal surface 730*h*. As lubricant flows through the channel 104*h* it may seep between the first metal surface 720*h* and the second metal surface 730*h*. It is believed that this seeping of lubricant between the first metal surface 720*h* and second metal surface 730*h* may allow the roller cone 122*h* to rotate around the journal 705 for a prolonged period of time. The roller cone 122*h* may also rotate with respect to thrust bearings 740 designed to support an axial load. The thrust bearings 740 may be hydrodynamic thrust bearings or diamond thrust bearings. Diamond thrust bearings suitable for use in the embodiment shown are disclosed in U.S. Pat. No. 5,092,687 to Hall or U.S. Pat. No. 4,729,440 to Hall, which are herein incorporated by reference for all that they disclose.

Figure 8A:
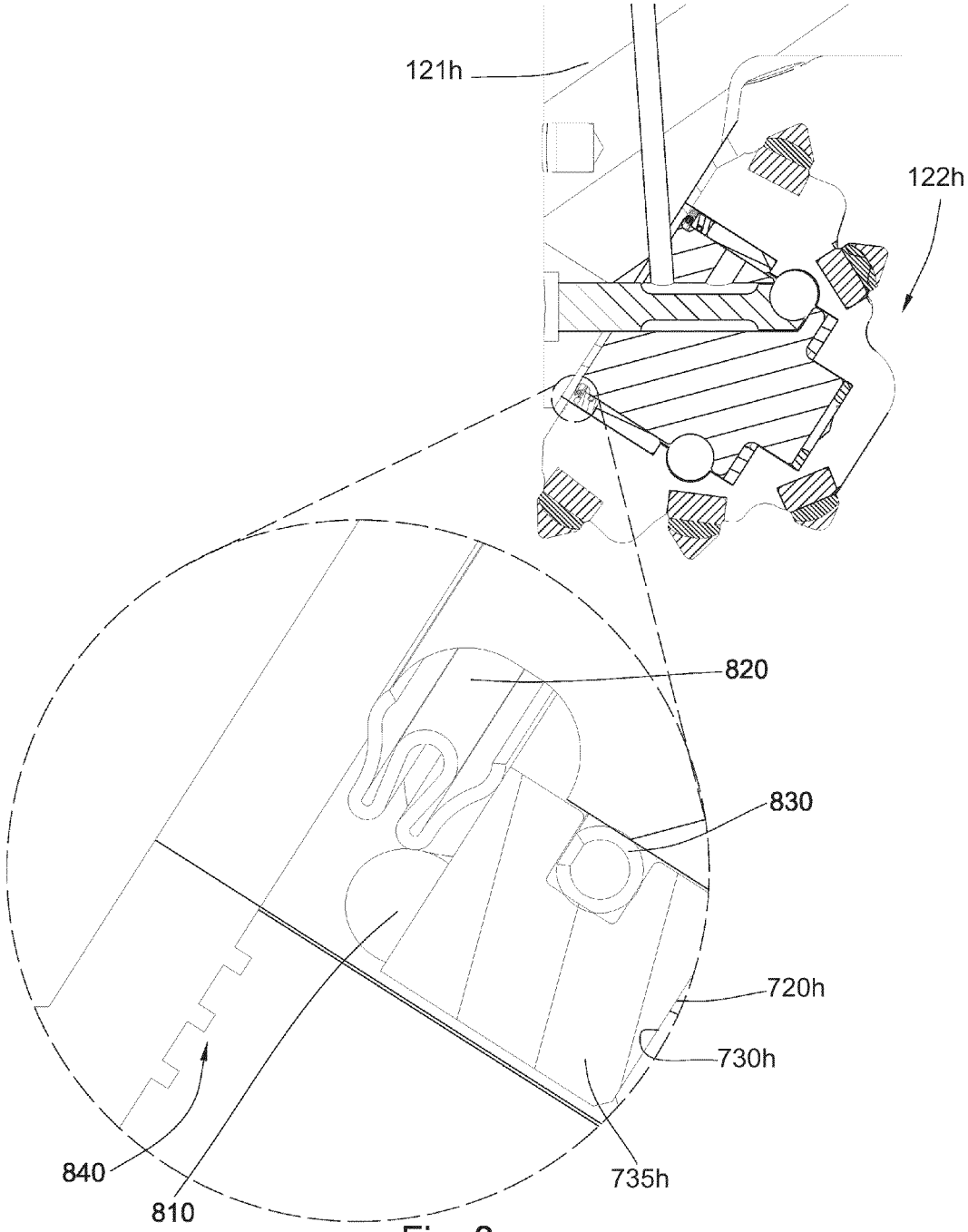
FIG. 8*a* is a cross-sectional view of an embodiment of a roller cone comprising a close-up view of a seal element.

FIG. 8*a* shows a close-up, cross-sectional view of the embodiment of FIG. 7 of the roller cone 122*h* attached to the roller cone bit 121*h*. The close-up, cross-sectional view includes a close-up view of the seal element 735*h*. The second metal surface 730*h* of the seal element 735*h* may be biased toward the first metal surface 720*h* by an E-clip, wave spring, elastic washer or other elastic material known in the art. In this embodiment, the second metal surface 730*h* of the seal element 735*h* is biased toward the first metal surface 720*h* by a wave spring 810 and an E-clip 820. It is believed that the elasticity of the wave spring 810 and/or E-clip 820 may determine the rate at which lubricant seeps between the first metal surface 720*h* and second metal surface 730*h*. It is further believed that as lubricant seeps past the seal element 735*h* it may flush debris away from the seal element 735*h*, thus allowing it prolonged operation.

The seal element 735*h* may comprise a C-clip 830 or other metallic seal known in the art. The C-clip 830 or other metallic seal may block lubricant from escaping via alternate paths thus forcing the lubricant to seep between the first metal surface 720*h* and second metal surface 730*h*. The roller cone 122*h* may comprise a tortuous path 840. The tortuous path 840 may hinder debris from traveling past the tortuous path 840 and wearing on the seal element 735*h*.

Figure 8B:
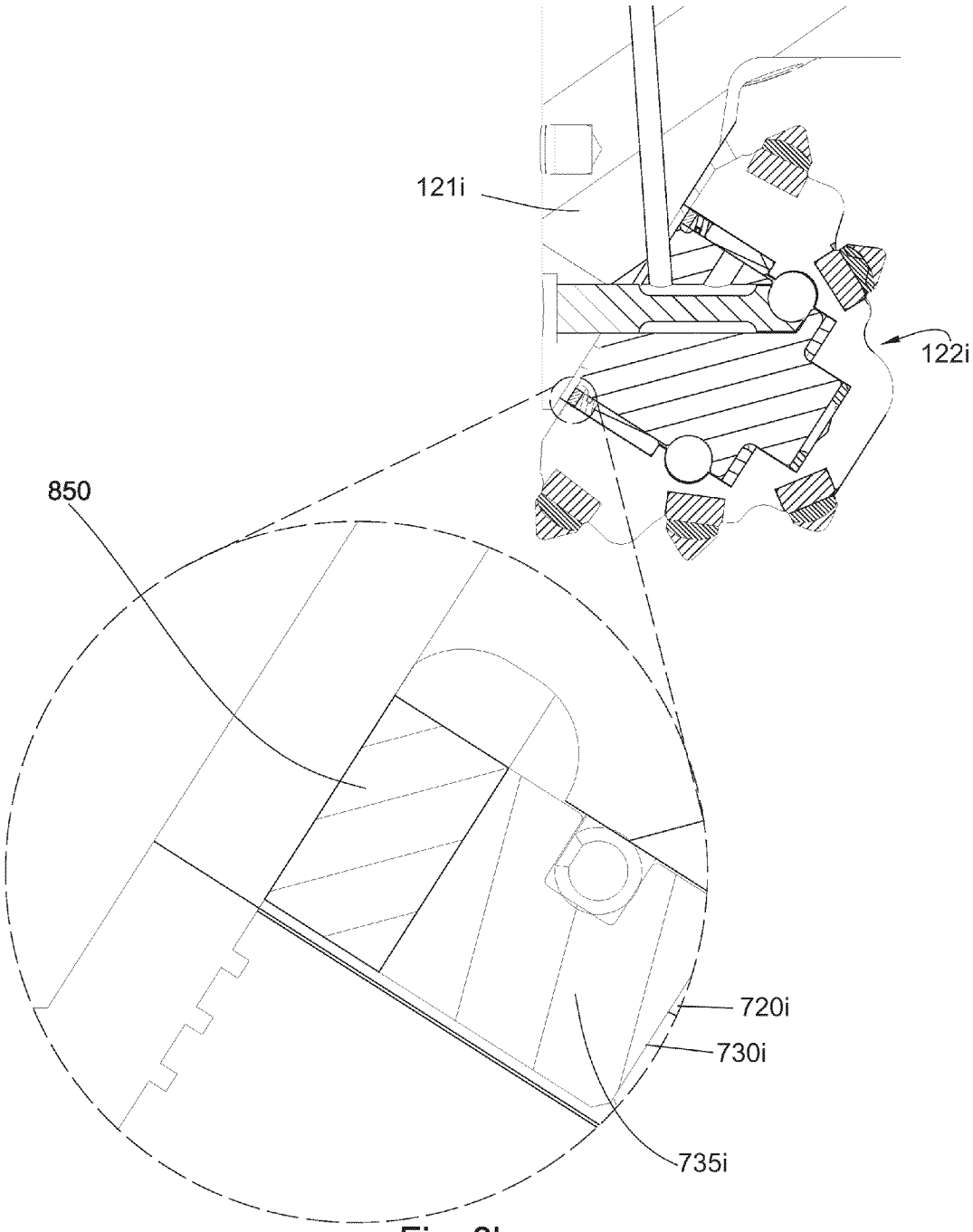
FIG. 8*b* is a cross-sectional view of another embodiment of a roller cone comprising a close-up view of a seal element.

FIG. 8*b* shows a cross-sectional view of another embodiment of a roller cone 122*i* attached to a roller cone bit 121*i* comprising a close-up view of the seal element 735*i*. In this embodiment, the second metal surface 730*i* of the seal element 735*i* is biased toward the first metal surface 720*i* by an elastic ring 850. It is believed that the elasticity of the elastic ring 850 may determine the rate at which lubricant seeps between the first metal surface 720*i* and second metal surface 730*i*.

Figure 9:
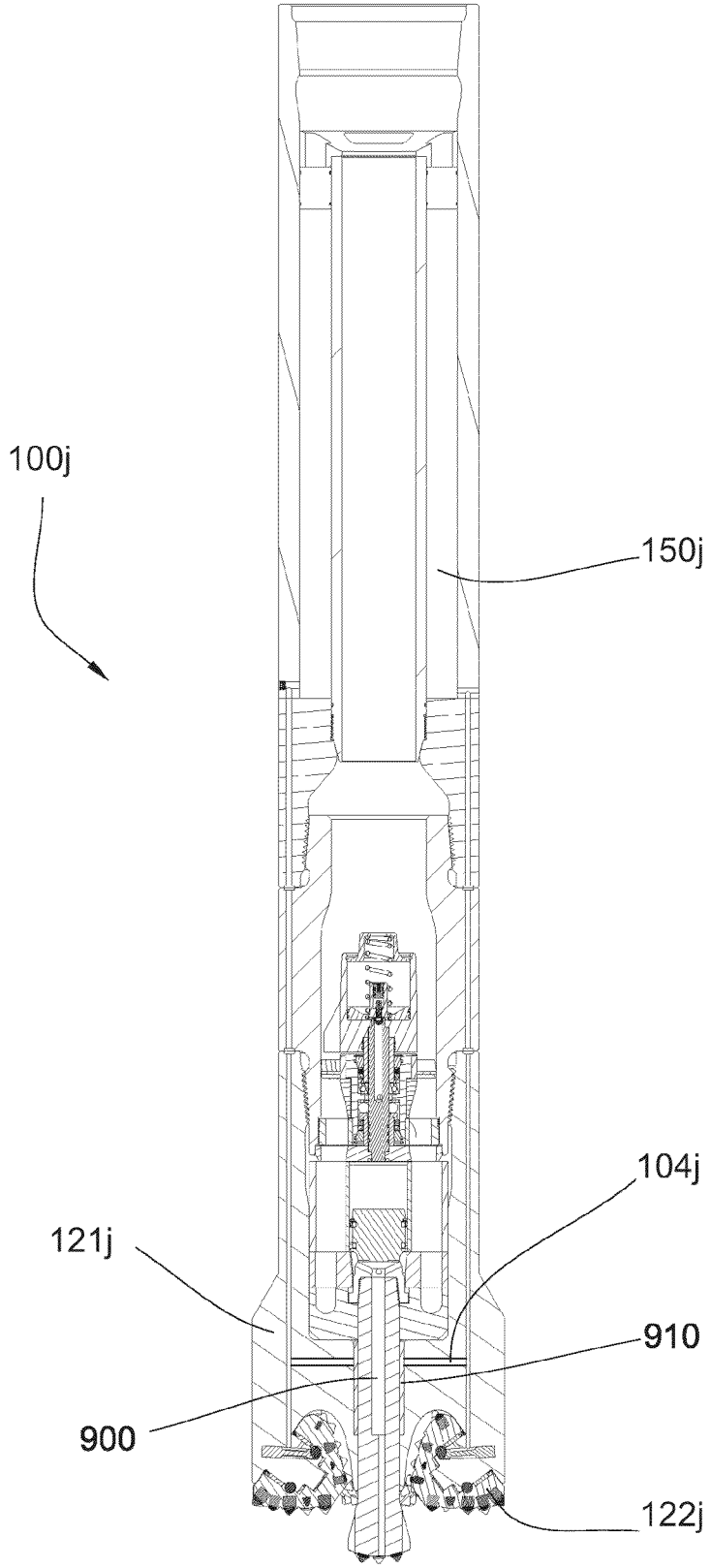
FIG. 9 is a cross-sectional view of an embodiment of a drill string component comprising a lubrication system and a hammer.

FIG. 9 shows a cross-sectional diagram of an embodiment of a drill string component 100*j* with a jack element 900. The jack element 900 may be used in downhole drilling applications to loosen earthen formations before they are engaged by the roller cones 122*j* of a roller cone bit 121*j*. The jack element 900 may accomplish this loosening of earthen formations by oscillating with respect to the roller cone bit 121*j*. As the jack element 900 oscillates, the lubrication assembly 150*j* may provide lubricant to bearing surfaces 910 surrounding the jack element 900 by means of a channel 104*j*.

Whereas the present invention has been described in particular relation to the drawings attached hereto, it should be understood that other and further modifications apart from those shown or suggested herein, may be made within the scope and spirit of the present invention.

What is claimed is:

1. A drill string component comprising:
   - a cylindrical body having a first end, a first outer surface and a first inner surface defining a first inner bore;
   - an insert disposed within said first inner bore, said insert having a second outer surface and a second inner surface defining a second inner bore;
   - a reservoir formed between said first inner surface and said second outer surface;
   - a fluid disposed within said reservoir;
   - a first mating surface at said first end of said cylindrical body;
   - a channel for communicating said fluid between said reservoir and said first mating surface;
   - a piston within said reservoir, said piston being operable from a first position to a second position spaced from said first position, said piston adapted to urge said fluid through said channel; and
   - means for urging said piston from first position to said second position.

2. The drill string component of claim 1, wherein said cylindrical body has a length and wherein a volume of said reservoir is determined by said length of said cylindrical body.

3. The drill string component of claim 1, wherein said insert is removable.

4. The drill string component of claim 3, further comprising a coupling mechanism disposed at said first end of said body.

5. The drill string component of claim 4, wherein the coupling mechanism is a threadform.

6. The drill string component of claim 3, wherein a volume of said reservoir is determined by a length of said insert.

7. The drill string component of claim 1, further comprising:

a port in fluid communication between said channel and said first outer surface; and a plug within said port, said plug hindering movement of any fluid through said port.

8. The drill string component of claim 7, wherein said plug is a Zerk fitting.

9. The drill string component of claim 7, wherein said plug is a check valve.

10. The drill string component of claim 7, wherein said plug is an external covering.

11. The drill string component of claim 10, wherein the external covering is a threaded securement.

12. The drill string component of claim 1, wherein said first mating surface has an annular gap in fluid communication with said channel.

13. The drill string component of claim 12, wherein said annular gap is segmented.

14. The drill string component of claim 12, further comprising a bit disposed adjacent said first mating surface, wherein said bit includes a second mating surface disposed adjacent said first mating surface.

15. The drill string component of claim 14, wherein said annular gap is disposed on both said first mating surface and said second mating surfaces.

16. The drill string component of claim 14, wherein said bit includes a bearing surface and wherein the drill string component further comprises a plurality of channels extending from said reservoir to said bearing surface.

17. The drill string component of claim 1, further comprising a lubricant disposed within said reservoir, wherein said lubricant has an operating range of 25 degrees C. to 350 degrees C.

18. The drill string component of claim 1, wherein said reservoir has an axial length from 4 inches to 30 feet.

19. The drill string component of claim 1, wherein the reservoir has a capacity from 0.4 gallons to 45 gallons.

20. The drill string component of claim 1, wherein said means for urging said piston includes a spring.

21. The drill string component of claim 1, further comprising a second fluid, wherein said means for urging said piston includes a pressure of said second fluid.

* * * * *